US008128463B2

(12) United States Patent
Lemaire et al.

(10) Patent No.: US 8,128,463 B2
(45) Date of Patent: Mar. 6, 2012

(54) METHOD AND DEVICE FOR TRIMMING A LENS BY CUTTING SAID LENS

(75) Inventors: Cedric Lemaire, Charenton-le-Pont (FR); Michel Nauche, Charenton-le-Pont (FR)

(73) Assignee: Essilor International (Compagnie Generale d'Optique), Charenton-le-Pont (FR)

( * ) Notice: Subject to any disclaimer, the term of this patent is extended or adjusted under 35 U.S.C. 154(b) by 678 days.

(21) Appl. No.: 12/299,659

(22) PCT Filed: Apr. 24, 2007

(86) PCT No.: PCT/FR2007/000696

§ 371 (c)(1), (2), (4) Date: Nov. 5, 2008

(87) PCT Pub. No.: WO2007/128904

PCT Pub. Date: Nov. 15, 2007

(65) Prior Publication Data

US 2009/0068932 A1 Mar. 12, 2009

(30) Foreign Application Priority Data

May 10, 2006 (FR) ..... 06 04133
May 19, 2006 (FR) ..... 06 04493

(51) Int. Cl.
*B24B 1/00* (2006.01)
*B24B 9/00* (2006.01)

(52) U.S. Cl. ..... 451/43; 451/178

(58) Field of Classification Search ..... 451/10, 451/11, 42–44, 178, 241, 255, 256, 277, 451/323

See application file for complete search history.

(56) References Cited

U.S. PATENT DOCUMENTS

| | | | | |
|---|---|---|---|---|
| 6,508,692 | B2 * | 1/2003 | Gottschalk | 451/5 |
| 6,712,671 | B2 * | 3/2004 | Wallendorf et al. | 451/11 |
| 2001/0051490 | A1 | 12/2001 | Siders et al. | |
| 2006/0240747 | A1 * | 10/2006 | Natsume et al. | 451/5 |

FOREIGN PATENT DOCUMENTS

| | | |
|---|---|---|
| DE | 3804133 | 8/1989 |
| DE | 19738668 | 3/1999 |
| EP | 1616663 | 1/2006 |
| FR | 2887168 | 12/2006 |
| WO | 2006117443 | 11/2006 |

OTHER PUBLICATIONS

International Search Report dated Aug. 28, 2007, in the PCT application.

* cited by examiner

*Primary Examiner* — Dung Van Nguyen
(74) *Attorney, Agent, or Firm* — Young & Thompson

(57) ABSTRACT

The present invention relates to a device and to a method for shaping an optical lens. According to the invention, a selection is provided between either a first tool (50) for machining the edge face of the lens, and a cutter tool (637) for cutting through the material of the lens, for the purpose of performing at least one given shaping operation. The invention also provides a method of shaping an optical lens coated in a treatment with low surface energy, the method including cutting through the material of the lens.

17 Claims, 1 Drawing Sheet

Fig.1
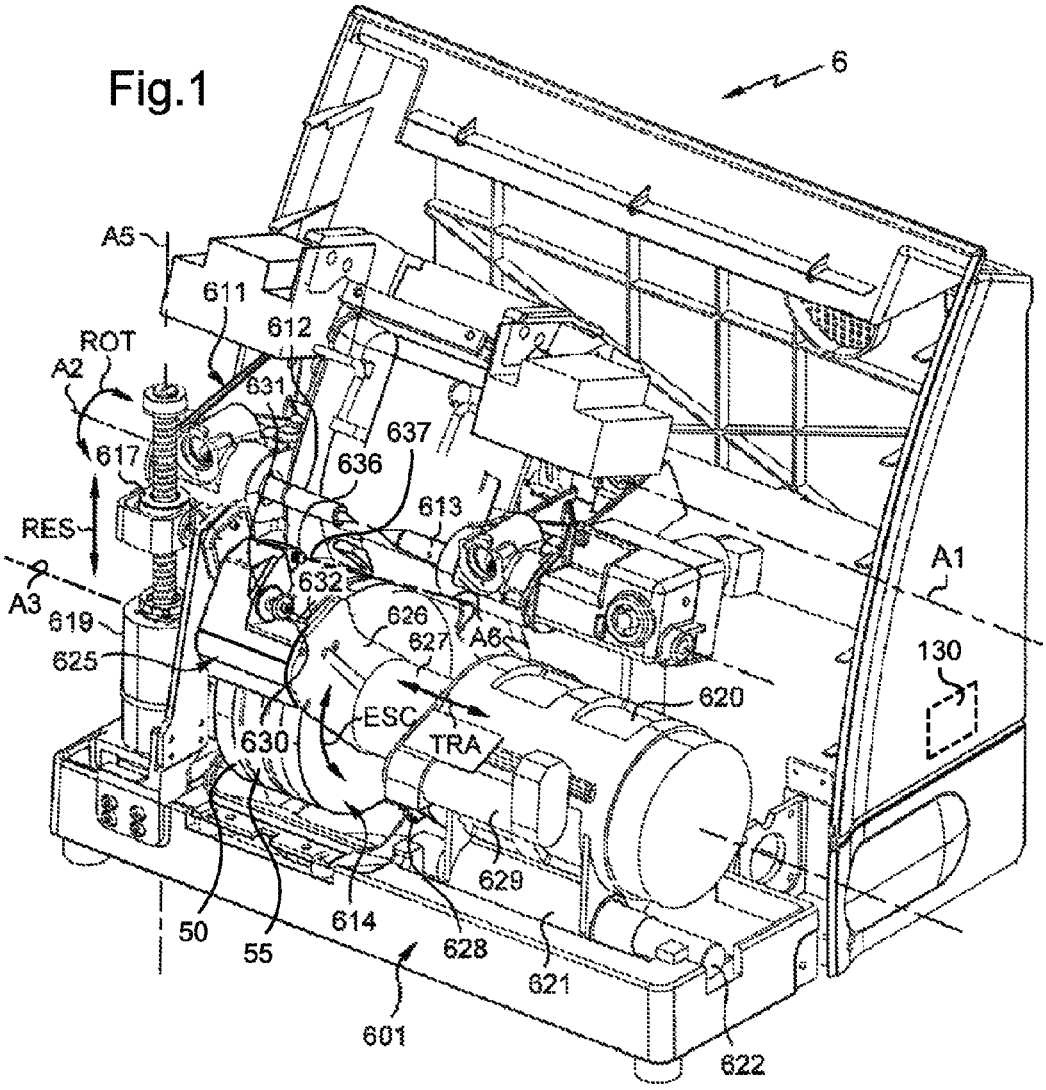
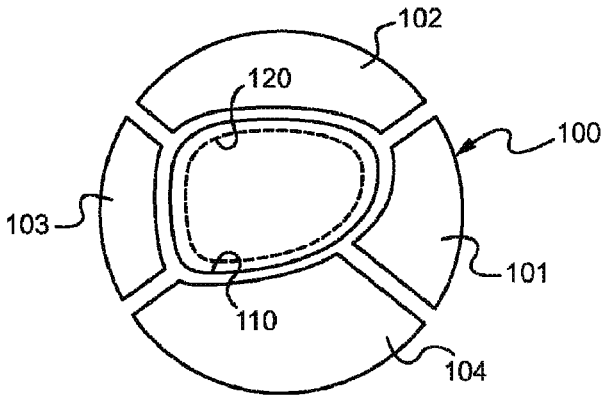
Fig.2

METHOD AND DEVICE FOR TRIMMING A LENS BY CUTTING SAID LENS

TECHNICAL FIELD TO WHICH THE INVENTION RELATES

The present invention relates in general to mounting the ophthalmic lenses of a correcting pair of eyeglasses in a frame, and it relates more particularly to a method and to a device for shaping an ophthalmic lens of a pair of eyeglasses in order to enable it to be mounted in a frame.

TECHNOLOGICAL BACKGROUND

The technical part of the profession of an optician consists in mounting a pair of ophthalmic lenses in or on a frame selected by the wearer.

This mounting comprises two main operations:

centering each lens, which consists in positioning and orienting the lens appropriately relative to the eye of the future wearer; and then shaping each lens, which consists in machining or cutting its outline to the desired shape, taking account of the defined centering parameters.

The present invention relates to the second operation of "shaping". Shaping a lens to enable it to be mounted in or on the frame selected by the future wearer consists in modifying the outline of the lens so as to match it to the frame and/or to the desired lens shape. Conventionally, shaping comprises two main operations: an edging operation (or "roughing-out" operation); and a finishing operation that is adapted to the type of frame. Shaping consists in eliminating an unwanted peripheral fraction of the ophthalmic lens in question so as to bring its outline, which outline is usually initially circular, down to the arbitrary outline of the rim of the eyeglass frame in question or merely to the desired shape of pleasing appearance when the frame is of the rimless type. This shaping operation is usually followed by a chamfering operation that consists in rounding or chamfering the two sharp edges of the edged lens. The finishing operation depends on the way mounting is to be performed. When the frame is of the rimmed type, chamfering is accompanied by beveling which consists in forming a rib generally referred to as a bevel. The bevel is designed to engage in a corresponding groove, commonly referred to a bezel, that is formed in the rim of the eyeglass frame in which the lens to be mounted. When the frame is of the rimless type, the shaping of the lens and optionally the rounding (chamfering) of its sharp edges is/are followed by drilling the lens appropriately so as to enable the side branches or "temples", and the nose bridge of the rimless frame to be fastened there to. Finally, when the frame is of the nylon string type, chamfering is accompanied by grooving that consists in forming a groove in the edge face of the lens, which groove is to receive the nylon string of the frame for pressing the lens against the rigid portion of the frame.

Usually, these operations are performed one after another on a single machine tool or grinder that is fitted with a set of appropriate grindwheels. Drilling can be performed on the grinder, in which case it is fitted with the corresponding tool, or else it is performed on a distinct drilling machine.

The operations of shaping and finishing can themselves be subdivided into a plurality of sub-operations, for example: roughing out, finishing, and polishing.

Usually, the lens is shaped on a numerically controlled grinder that possesses means for holding and driving the lens in rotation together with a plurality of grindwheels that are appropriate for the various operations to be performed. The lens is initially blocked on the holder-and-drive means in a known configuration such that its optical frame of reference is known, thereby enabling the operations to be performed accurately relative to said frame of reference. It will be understood that such blocking, accompanied by storing the optical frame of reference in a memory, serves to define and physically identify on the lens a geometrical frame of reference specifying characteristic points and directions of the lens, as are needed for matching it with the position of the pupil, together with shaping values so that the characteristic points and directions are properly positioned in the frame.

Recently, a new type of lens has become available on the market in which holding and driving difficulties have arisen. In order to limit dirtying of the faces of ophthalmic lenses, in particular for anti-reflection lenses, it is known to apply a specific coating to one or both faces of the lens, which coating is said to possess "low surface energy". Such specific coatings have the feature of preventing adhesion of water (water-repellent coating) or of grease (oil-repellent coating).

Unfortunately, such coatings make the surfaces of the lens on which they have been deposited very slippery. The adhesive used for placing the centering-and-drive pad then adheres weakly to the slippery face of the lens. The same problem arises when applying blocking chucks that adhere weakly to the faces of the lens. While shaping the lens, the grindwheels that are removing material exert generally circumferential forces (friction forces) on the edge face of the lens, thereby generating high torque on the lens, in particular during roughing out of the lens during which a large quantity of material is ground away. As a result, during shaping, in particular during roughing out, the lens slips relative to the means for holding and turning the lens (the pad or the chucks). The centering of the lens, and in particular the orientation of its axis (i.e. the angular orientation of the lens in the frame of reference of the grinder) is then modified and the outline obtained for the lens differs, relative to its own optical frame of reference, from the final outline desired after shaping.

One solution consists in reducing the quantity of material that is removed on each grinding pass so as to reduce the torque exerted on the edge face of the lens. However that solution does not give satisfaction, and in any event significantly lengthens cycle times.

For blocking the lens with a pad, it is also known to apply an interface on the slippery coating so as to increase adhesion with the adhesive used for placing the pad. That solution does not give full satisfaction either, and overall it lengthens production throughput rates.

A similar problem arises when shaping lenses of thickness and material that make them fragile and that expose their coatings to a risk of cracking. It can be understood that a lens of small thickness made of a material that is deformable, such as polycarbonate, deforms in bending while it is being clamped between the support and rotary drive shafts of the shaper machine. Such deformation of the lens can reach excessive levels, leading to cracking of the coatings on the lens, which is unacceptable and causes the lens to be discarded. To avoid that phenomenon, it is necessary to reduce the deformation of the lens, and for this purpose to reduce the magnitude of the force clamping the lens between the support and rotary drive shafts of the shaper machine.

Furthermore, when subjected to machining, certain organic materials that are used in the composition of lenses give off substances that are smelly. This applies in particular to organic materials having medium and high refractive indices, typically indices greater than 1.6. It can readily be understood that giving off such smells is harmful, not only for the working conditions of operators acting on or near the shaper machines, but also in terms of client satisfaction when the workshop for preparing lenses for mounting is close to a sales area or is merely being visited.

Another problem arises when it is desired to shape a lens around an outline of sophisticated shape, in particular a shape presenting one or more concave portions which, seen in the mean plane of the lens, presents points of inflection. Under such circumstances, the shape generally cannot be obtained using a conventional tool for machining the periphery of the lens, such as a grindwheel or a bladed cutter, since the conventional tool is of a diameter that is too great to comply with the points of inflection.

OBJECT OF THE INVENTION

An object of the present invention is to provide a method and a device for shaping that enables effective, accurate, and reliable shaping to be performed on lenses presenting a variety of properties possibly exposing them to a risk of slipping or of deformation during machining.

Another object of the present invention is to provide a method and a device for shaping that are capable of reducing the amount of smelly or harmful substances given off during the shaping of certain lenses.

Yet another object of the present invention is to provide a method and a device for shaping that are capable of shaping lenses to have complex shapes.

In order to achieve at least one of these objects, the invention provides a method of shaping an optical lens, the method including at least one operation of edging along a desired outline, the method being characterized in that it includes making a selection between either a first tool for machining the edge face of the lens, or a cutter tool for cutting through the material of the lens, in order to perform the edging operation.

The invention also provides a device for shaping an optical lens, the device comprising:

- a first tool for machining the edge face of the lens;
- a cutter tool for cutting through the material of the lens;
- holder means for holding the lens during shaping; and
- selector means for selecting either the first tool for machining the edge face of the lens, or the cutter tool for cutting the lens, for at least one given shaping operation.

For a lens having properties that expose it to a risk of slipping, of deforming, or of giving off unpleasant substances while being machined, the cutter tool is selected, thus enabling the desired radius to be reproduced at each point around the outline of the lens while machining away only a small quantity of material. The quantity of material machined by cutting corresponds to the length of the path followed by the cutter tool (namely the outline desired for the lens) multiplied by a width corresponding to the diameter of the cutter tool. Unlike machining the edge face of the lens, there is no need to machine away all of the material situated between the periphery or raw outline of the lens and the outline desired for the lens.

The small amount of material that is machined during cutting out makes it possible:

- to limit the total amount of energy transmitted to the lens by friction and thus to limit slip of the lens relative to its holder means; and/or
- to reduce the quantity of smelly substance that is given off during the machining operation.

By way of concrete example, the volume of material that is machined away by cutting through the material by means of a cutter having a diameter of 1.5 millimeters (mm) is evaluated as being about only one-tenth the volume of material that is machined away by grinding using a grindwheel with a diameter of 155 mm.

When machining a lens that has a slippery coating, this makes it possible with a normal degree of clamping to avoid the lens slipping during machining, thus making it possible for lenses that present a slippery coating to be shaped accurately. When machining a lens that is fragile, this makes it possible firstly to limit the clamping force applied to the lens during machining, without that leading to slip, and secondly to limit the force exerted by the cutting-out tool (which is less than the force exerted by a grindwheel of large diameter), thereby avoiding the lens bending excessively. For a lens made of a material that contains smelly substances, reducing the total volume of material that is machined achieves a corresponding reduction in the quantity of smelly substances to be released by machining.

In contrast, with a lens that has no tendency to slip or that does not present any particular fragility or that is made of a material containing little or no smelly substance that will be given off during machining, or that has a desired final outline that does not present any point of inflection, it is possible to select the first machining tool, so as to obtain the desired outline more quickly and avoid the cutting-out tool wearing too rapidly.

Thus, it is possible to select as a working tool either the cutting-out tool (for which the risk of lens slip for given clamping force and/or of smelly substances being given off is reduced during shaping), or else the first machining tool if the lens is unlikely to slip, is not fragile, and does not contain smelly substances. Lens shaping is then more effective, accurate, and reliable, and the operator and people nearby are not inconvenienced.

Choosing between machining the edge face of the lens or cutting through the material of the lens depends on criteria relating to one and/or other of the risks encountered in the specific shaping operation that is to be performed: lens slip; lens cracking; giving off unpleasant substances.

According to a first advantageous characteristic of the invention, the lens is held during edging by holder means, and said selection is performed as a function of one or more of the following parameters taken in isolation or in combination: a parameter relating to the lens; a parameter relating to the machining or cutting tools; a parameter relating to the lens holder means; and a parameter relating to the shape of the outline desired for the lens.

The parameter(s) taken into account serves in particular to determine whether the lens is of slippery or non-slip nature, whether it is fragile, or whether its material is of a kind that will give off smelly substances.

The parameter(s) advantageously comprise one or more of the following parameters:

- the wetting angle of at least one of the faces of the lens;
- the maximum torque value that can be applied to the lens without it slipping relative to its holder means during edging;
- the thickness of the lens;
- the material constituting the lens; and
- the presence or absence in the composition of the material constituting the lens of smelly substances that will be given off during machining.

According to another advantageous characteristic of the invention, the given shaping operation for which said selection is performed, is roughing out followed by finishing that is performed using a second tool for machining the edge face of the lens and that is distinct from the first tool for machining the edge face of the lens.

Roughing out the shape by cutting (often referred to as edging) serves to limit slip of the lens without significantly increasing the cycle time for the lens. By finishing the shaping of the lens with a grindwheel it is possible to machine the periphery of the roughed-out lens accurately so as to obtain a desired outline with accurate dimensions. The quantity of material that remains between the rough outline and the desired outline and that is to be machined away is small and therefore limits the friction and the torque exerted by the finishing grindwheel on the lens. In addition, the radius of the lens is substantially smaller after roughing out, thereby mechanically reducing the torque transmitted from the grindwheel to the lens.

According to another advantageous characteristic of the invention, the diameter of the tool for cutting through the material of the lens is substantially less than the diameter of the first tool for machining the edge face of the lens.

Since the diameter of the cutter tool is less than that of a grindwheel, the torque exerted by the cutter tool on the lens is much less than the torque exerted by the grindwheel on the lens, for a given quantity of material to be removed, thereby limiting slip of the lens.

According to another advantageous characteristic of the invention, the diameter of the tool for cutting through the material of the lens is substantially less than the radius of the lens.

The small diameter of the cutter tool makes it possible to cut through the material of the lens. The smaller the diameter of the cutter tool, the greater the extent to which the friction forces and the torque exerted on the lens are limited. Lens slip is then reduced, and shaping more accurate.

According to another advantageous characteristic of the invention, the cutting of the lens comprises a plurality of cutting passes each made along the desired outline, each with a small axial cutting depth, i.e. less than the thickness of the lens.

Performing a plurality of passes, while increasing the pass depth on each occasion, enables the lens to be cut while limiting the quantity of material that is removed on each pass and thus reducing the torque that is exerted by the cutter tool on the lens.

Prior to cutting, at least one face of the lens is felt along the desired outline, and during at least one cutting pass, the cutter tool is controlled axially as a function of the feeler data picked up in this way.

Advantageously, the step sizes of the axial pass cutting depths are adjustable.

Adjusting the step size of the axial depth between two passes serves to vary the quantity of material that is to be removed on each pass and thus to adapt the torque exerted by the cutter tool on the lens so as to limit slip of the lens.

According to another advantageous characteristic of the invention, the lens is driven in rotation relative to the cutter tool about an axis that is substantially parallel to the axis of the lens, and the direction of rotation is reversed between two successive cutting passes.

Reversing the direction of rotation between two cutting passes serves to reverse the direction of the torque exerted by the cutter tool on the lens and thus the direction of slip between the lens and the holder means. Slip of the lens in one direction is then compensated by slip of the lens in the other direction, thereby limiting the total resulting slip between the lens and the holder means.

According to another advantageous characteristic of the invention, the lens is driven in rotation relative to the cutter tool about an axis substantially parallel to the axis of the lens, and at least a portion of a cutting pass is performed with a first direction of rotation, and the remaining portion of said pass is performed with a second direction of rotation opposite to the first direction.

Reversing the direction of rotation during a given cutting pass likewise serves to limit the total slip of the lens during said pass.

According to another advantageous characteristic of the invention, cutting out the lens comprises not only cutting out the lens along the desired outline, but also cutting out along radial sector lines lying between a plurality of peripheral sectors.

Cutting the lens so as to make a plurality of scrap portions serves to limit the stresses exerted on the lens by the portion of the lens that is situated between the periphery of the lens and the desired outline that has just been cut, but that remains attached to the lens.

Advantageously, the radial lines are cut prior to cutting along the desired outline. In practice, at least one face of the lens is felt along the radial sector lines. During cutting, the cutter tool is controlled axially as a function of the feeler data as picked up in this way.

According to another advantageous characteristic of the invention, said selection consists in using the cutter tool when at least one face of the optical lens is coated in treatment that gives the surface of said face of the optical lens a wetting angle that is greater than 100 degrees. The lens is said to have low surface energy.

The cutter tool is thus selected for lenses that tend to slip significantly. With the cutter tool, lens slip is limited during shaping thus making it possible to obtain the outline that is desired for the lens in a manner that is reliable, effective, and accurate.

According to another advantageous characteristic of the invention, the selection means comprise determination means designed to determine which of the first tool for machining the edge face of the lens and the tool for cutting is to be selected. Determining which working tool to use for roughing out the lens makes it possible to automate selection in part.

According to another advantageous characteristic of the invention, with the lens being held by holder means, the determination means include means for calculating the value of a parameter relating to the lens and/or relating to the machining or cutting tool and/or relating to the holder means, and the determination means are designed to determine which one of the first tool for machining the edge face of the lens and the tool for cutting the lens is to be selected as a function of the value of said parameter.

The calculation means enable to determine which working tool to use in application of predetermined criteria, thereby likewise contributing to automating selection of the working tool.

According to another advantageous characteristic of the invention, said parameter is the maximum torque value that can be applied to the lens without it slipping relative to the holder means.

According to another advantageous characteristic of the invention, the tool for cutting the lens is mounted to move relative to the lens in a direction parallel to the axis of said lens.

The invention also provides a method of shaping an optical lens coated in a treatment having low surface energy, the method including cutting through the material of the lens.

Shaping by cutting through the material of the lens when the lens has low surface energy, i.e. is of a slippery nature, enables the slip of the lens to be limited. The outline desired for the lens is thus obtained in a manner that is reliable, effective, and accurate.

DETAILED DESCRIPTION OF AN EMBODIMENT

The description below with reference to the accompanying drawing of an embodiment, given by way of non-limiting example, makes it clear what the invention consists in and how it can be reduced to practice.

In the accompanying drawing:

FIG. 1 is a perspective view of a shaper device for shaping an optical lens and fitted with a cutter module; and FIG. 2 is a face view of an optical lens edged by cutting out, the lens being shown in a mean plane thereof.

SHAPER DEVICE

FIG. 1 shows a shaper device 6 fitted with a cutter module 636 for cutting out an optical lens 100. The shaper device 6 is adapted to modify the outline of the ophthalmic lens so as to match it to the outline of the rim of a selected frame.

The shaper device comprises a rocker 611 mounted on a structure to pivot freely about a first axis A1, in practice a horizontal axis.

For the purposes of holding and rotating an ophthalmic lens that is to be machined, the shaper device is fitted with support means suitable for clamping and rotating an ophthalmic lens. These support means or holder means comprise two shafts 612, 613 for providing clamping and rotary drive. These two shafts 612, 613 are in alignment with each other on a second axis A2, referred to as the blocking axis, that is parallel to the first axis A1. The two shafts 612, 613 are driven to rotate synchronously by a motor (not shown) via a common drive mechanism (not shown) mounted on the rocker 611. The common mechanism for synchronous rotary drive is of the usual known type.

In a variant, it would also be possible to drive the two shafts by two distinct motors that are synchronized either mechanically or electronically.

The rotation ROT of the shafts 612, 613 can be controlled by a central electronic and computer system such as an incorporated microcomputer, or a set of dedicated integrated circuits.

Each of the shafts 612, 613 possesses a free end that faces the free end of the other shaft and that is fitted with a blocking chuck (not shown). Such blocking chucks are not always fastened to the shafts 612, 613. They are used beforehand by handling means (not shown) for blocking the lens prior to it being transferred to the presently-described shaper device 6, as they remain in contact with the lens being transferred.

The shaft 613 is movable in translation along the blocking axis A2 towards the other shaft 612 in order to clamp the lens in axial compression between the two blocking chucks. This axial translation movement of the shaft 613 is drive by a drive motor via an actuator mechanism (not shown) controlled by the central electronic and computer system. The other shaft 612 is stationary in translation on the blocking axis A2.

In practice, the shaper device has a set of machining tools 614 comprising firstly a first machining tool 50 for roughing out the shaping of the edge face of the lens 100. In this example the first machining tool 50 is a grindwheel, but in a variant it would be possible to use a roughing-out cutter. The size of the grains in the roughing-out grindwheel is of the order of 150 micrometers (μm) to 500 μm.

Provision is also made for the set of machining tools 614 to include a second tool 55 for machining the edge face of the lens 100, which second tool is distinct from the first tool 50 for machining the edge of the lens 100 and serves to finish shaping of the edge face of the lens 100. This second tool 55 for machining the edge face of the lens 100 is a finishing grindwheel that includes a beveling groove and it has grains of a size of the order of 55 μm. The roughing out and finishing grindwheels are cylindrical with a diameter of about 155 mm. Provision is also made for a polishing grindwheel in the set of machining tools 614 (or set of grindwheels).

The set of machining tools 614 is fitted on a common shaft of axis A3 serving to drive them in rotation during the shaping operation. This common shaft, which is not visible in the figures shown, is driven in rotation by an electric motor 620 under the control of the electronic and computer system.

The set of machining tools 614 is also movable in translation along the axis A3 and is driven in such translation under motor control. Specifically, the entire set of machining tools 614, together with its shaft and its motor is carried by a carriage 621 that is itself carried by slides 622 secured to the structure to slide along the third axis A3. The movement in translation of the grindwheel-carrier carriage 621 is referred to as transfer and is referenced TRA in FIG. 1. This transfer is driven by a motorized drive mechanism (not shown) such as a screw-and-nut system or a rack, under the control of the central electronic and computer system.

In order to enable the spacing between the axis A3 of the grindwheels 614 and the axis A2 of the lens to be adjusted dynamically during shaping, use is made of the ability of the rocker 611 to pivot about the axis A1. This pivoting produces movement of the lens clamped between the shafts 612, 613, which movement is substantially vertical in this example thereby moving the lens towards or away from the grindwheels 614. This ability to move makes it possible to reproduce the desired shape as programmed in the electronic and computer system, it is referred to as reproduction, and it is referenced RES in the figures. This reproduction movement RES is controlled by the central electronic and computer system.

In order to machine the ophthalmic lens to have a given outline, it is necessary to move a nut 617 in corresponding manner along a fifth axis A5 under drive from the motor 619 so as to control the reproduction movement, and it is also necessary simultaneously to cause the support shafts 612, 613 to pivot about the second axis A2, in practice under drive from the motor controlling them. The transverse reproduction movements RES of the rocker 611 and the rotary movement ROT of the lens shafts 612, 613 are controlled in coordinated manner by an electronic and computer system that is suitably programmed for this purpose so that all of the points on the outline of the ophthalmic lens are brought in succession to the appropriate diameter.

The shaper device shown in FIG. 1 also includes a working module 625 carrying chamfering and grooving wheels 630, 631 mounted on a common axis 632 that is movable with one degree of freedom in a direction that extends substantially transversely to the axis A2 of the shafts 612, 613 for holding the lens, and to the axis A5 for reproduction RES. This degree of freedom is referred to as retraction and is referenced ESC in the figures.

Specifically, this retraction consists in pivoting the working module 625 about the axis A3. The module 625 is carried by a lever 626 secured to a tubular sleeve 627 mounted on the carriage 621 to pivot about the axis A3. To control its pivoting, the sleeve 627 is provided at its end remote from the lever 626 with a toothed wheel 628 that meshes with a gearwheel (not shown in the figures) fitted on the shaft of an electric motor 629 that is secured to the carriage 621.

To summarize, the available degrees of freedom in movement on such a shaper device are as follows:

rotation of the lens enabling the lens to be turned about its holding axis, which axis is substantially normal to the general plane of the lens;

reproduction, which consists in the grindwheels being free to move transversely relative to the lens (i.e. in the general plane of the lens), making it possible to reproduce the various radii describing the outline of the shape desired for the lens;

transfer, which consists in the working tools being movable axially relative to the lens (i.e. perpendicularly to the general plane of the lens), thereby enabling the selected working tool to be positioned in register with the lens; and retraction, which consists in the working module being movable transversely relative to the lens in a direction that is different from the reproduction direction so as to enable the finishing module to be put into its utilization position and to be stowed out of the way.

The working module 625 is provided with a cutter module 636 fitted with a cutting-out tool 637 for roughing out the shaping by cutting through the material of the lens 100 (see FIG. 1). Cutting through consists in causing the entire diameter of the tool to penetrate into the lens and in moving the tool through the lens along a cutting path that enables the desired cut-out shape 110 to be obtained. The desired cut-out shape 110 is a desired roughed-out outline 110 having the same shape as the desired final outline, but larger in size.

Cutting through the lens material differs from machining the edge face of the lens in that when machining the edge face, only a small portion of the diameter of the machining tool engages in the material of the edge face of the lens, and all of the material that is situated between the raw periphery (or edge face) of the lens and the outline to be roughed out is machined away.

The cutting-out tool is a shank type milling cutter of axis A6 that is substantially parallel to the axis A2 of the shafts 612, 613 (i.e. the axis of the lens). In a variant, the cutting-out tool may be constituted by a grindwheel spindle, of smaller diameter than the roughing-out grindwheel or cutter, or indeed it may be a laser beam.

For example, the cutter presents a length of 12 mm and is made of tungsten carbide. To be able to cut out the lens by cutting through the material thereof, the diameter of the cutting-out tool 637 is much less than the diameter of the lens. The diameter of the cutter 637 for cutting through the material of the lens 100 is preferably less than 4 mm, and typically lies in the range 1 mm to 2 mm. By way of example, the diameter of the first machining tool or grindwheel 50 is about 155 mm. In other words, it can also be considered that the diameter of the cutter 637 is on average 1% to 6% of the radius of the lens 100 (which is typically about 70 mm).

The cutter is positioned using the two preexisting degrees of freedom in movement that are constituted by retraction ESC and by transfer TRA.

The shaper device 6 includes a controlling electronic processor unit 130, also referred to as an electronic and computer system, constituted in this embodiment by an electronic card designed to control in coordinated manner the various freedoms in movement of the working tools and of the means for clamping and driving the lens in rotation (the holder means), in order to apply an automatic shaper method as explained below.

By way of example, the electronic and computer system 130 comprises in conventional manner a mother board, a microprocessor, random access memory (RAM), and permanent mass memory. The mass memory contains a program for performing the shaping method, as described below. The mass memory is preferably rewritable and advantageously removable so as to enable it to be replaced quickly or to be programmed on a remote computer via a standardized interface. Means are also provided for storing the final outline 120 desired for the lens. These storage means may be constituted by rewritable memory and by an interface (e.g. a keyboard and a screen) for writing in said memory.

Finally, the electronic and computer system 130 has selector means for selecting either the first tool 50 for machining the edge face of the lens 100, or the tool 637 for cutting the lens 100, for at least one given shaping operation. The selector means comprise determination means designed to determine which of the first tool 50 for machining the edge face of the lens 100 and the tool 637 for cutting the lens 100 is to be selected. For this purpose, the determination means comprise means for calculating the value of a parameter relating to the lens and/or to the machining and cutting tools and/or relating to the means for holding the lens 100. The determination means also include means for comparing said value with a reference value and they are designed to determine which of the first tool 50 for machining the edge face and the tool 637 for cutting the lens 100 should be selected as a function of the result of the comparison.

Shaping Method

The characteristics relating to the optical lens 100 for shaping, such as the desired final outline 120 and the surface energy of the lens are stored in the electronic processor unit. The surface energy of the lens can be quantified in terms of its wetting angle. For a drop of water present on the face of the lens in question, the wetting angle is defined as being the angle formed between the plane tangential to the surface of the drop of water at a point where said surface contacts the lens and the plane tangential to the surface of the face of the lens at said point of contact with the surface of the drop of water. The greater this angle, the lower the surface energy, and thus the more slippery the lens.

A selection is made between either the first tool 50 for machining the edge of the lens 100 or the tool 637 for cutting through the material of the lens 100, so as to perform at least one given shaping operation. The given shaping operation for which said selection is undertaken in this example is roughing out the shape of the lens, followed by finishing performed using the second tool 55 for machining the edge face of the lens 100.

This selection is carried out as a function of one or more parameters relating to the lens, such as the friction capacity of one or both faces held by the holder means, and/or the thickness, and/or the material of the lens. Selection can also be carried out as a function of parameters relating to the lens holder means, such as the friction capacity of the holder means.

Tool selection can be carried out as a function of four categories of parameters, optionally in combination:

a first category of parameters relating to the slippery or non-slippery nature of the surface of the lens;

a second category of parameters relating to the stiffness of the lens;

a third category of parameters relating to the presence or absence in the composition of the material constituting the lens of smelly substances that would be released during machining; and a fourth category of parameters relating to the shape of the outline desired for the lens after shaping.

By way of example, the first category of parameters comprises the maximum value of the torque that can be applied to the lens 100 before it slips relative to the holder means 612, 613. This acceptable torque value depends simultaneously on the holder means, on the force with which they are pressed against the lens, and on the surface of the lens. The comparator means compare this calculated maximum value with a reference value. By way of example, the reference value might be 2 newton-meters (Nm). If this calculated maximum value is greater than the reference value, then the first tool 50 is selected for roughing out the shape, while if this calculated maximum value is less than or equal to the reference value, then the cutting-out tool 637 is selected to rough out the shaping by cutting through the material. Under such circumstances, it is said that the optical lens presents low surface energy.

Another parameter relating to the slippery or non-slippery nature of the surface of the lens that can be taken into account when selecting the tool is the wetting angle. If the wetting angle is greater than 100°, it is considered that the optical lens presents low surface energy and the cutting-out tool is selected.

By way of example, it can be assumed that the lens has a water-repellent and/or oil-repellent coating that makes both of its surfaces slippery. It follows that the maximum value of the torque that can be applied to the lens 100 without its slipping relative to the holder means 612, 613 is then about 0.3 Nm. It can be seen that under such circumstances it is necessary to select the cutting-out tool.

The tool can also be selected as a function of the stiffness of the lens. If the thickness and/or the material of the lens runs the risk of the lens becoming deformed, then the force clamping the lens to its support means is reduced and in order to avoid the lens slipping, the cutting-out tool is selected for roughing out the shape. Selection can also be carried out as a function of a combination of the thickness and the material of the lens.

The tool may also be selected as a function of the presence or absence of smelly substances in the composition of the material constituting the lens, which substances would be released during machining. This criterion depends above all on the nature of the material(s) constituting the lens. For example, most lenses made of a material possessing an index of refraction that is medium or large, i.e. specifically an index greater than 1.6, presently contain substances that give off many substances during machining. In order to take this criterion into account, the electronic processor unit possesses or accesses a local or remote register in which each record relates to a material or a category of materials and contains not only an identifier for the material or the category of materials, but also a flag indicating the presence or the absence in the composition of the material or the category of materials of many substances that will be released during machining.

Another criterion for selecting the tool is the shape desired for the final outline of the lens. If this shape presents one or more portions of concave shape, i.e. the projection of the outline onto the midplane of the lens presents one or more points of inflection, then it is probably not possible to obtain that shape by a conventional tool for machining the periphery of the lens, such as a grindwheel or a cutter of diameter that is too great to comply with the points of inflection.

In any event, if the lens is detected by the electronic processor unit as being slippery or fragile, or if the material of the lens contains smelly substances, or indeed if the shape desired for the outline of the lens possesses one or more concave portions, then in application of the above-mentioned criteria the processor unit acts via a suitable interface such as a screen associated with a keyboard, etc., to suggest to the operator that the cutting-out tool should be selected for roughing out the shape of the lens. In a variant, the electronic processor unit may also select the tool and the corresponding shaping method automatically, without having recourse to any dialog with an operator.

As set out above, this method of shaping by cutting through the material serves to reduce the risk of the lens slipping relative to its holder means and/or to reduce the quantity of smelly substances given off. It also makes it possible to edge the lens with an outline that is complex in shape, such as a shape presenting one or more concave portions including points of inflection, i.e. a shape that cannot be made using a conventional grindwheel or cutter for working the periphery of the lens.

During cutting out, the electronic processor system 130 controls with appropriate coordination the freedoms to move in transfer TRA of the working module 625 carrying the cutting-out tool 637, in reproduction RES of the clamping and rotary drive shafts 612, 613, in retraction ESC of the working module 625, and in rotation ROT of the lens to move the cutting-out tool relative to the lens appropriately for cutting out the lens.

In a first implementation, in order to cut through the material, the cutting-out tool is rotated about its axis A6 that is positioned along an axis parallel to the lens so as to enter into the material of the lens by moving transversely. The cutting-out tool 637 is also positioned axially in such a manner that during its transverse movement, it passes right through the lens between its two faces. The cutting-out tool 637 is then moved transversely relative to the axis of the lens 100 so as to obtain the desired roughed-out shape 110. The roughed-out shape 110 has the desired final outline 120 but is of slightly greater size.

In a variant not shown, the roughed-out shape 110 and the final outline 120 presents one or more portions of concave shape, i.e. the projection of said outline onto a midplane of the lens (as shown in FIG. 2) presents (unlike the example shown in FIG. 2) one or more points of inflection. As mentioned above, the tool for cutting through the material is then selected, or at least suggested.

As shown in FIG. 2, the roughing out of the lens comprises cutting along radial sector lines 105, 106, 107, and 108 separating a plurality of peripheral sectors of the lens into a plurality of portions.

The peripheral sectors cut out from the lens constitute pieces of scrap 101, 102, 103, 104 that are discarded, together with a remaining central portion of the lens that is held by the holder means 612, 613 and that presents the desired roughed-out shape 110. Each piece of scrap is obtained by the cutting-out tool 637 penetrating substantially along a radius of the lens 100 and moving towards the center of the lens 100 until it reaches the roughed-out shape 110 that is to be made, after which it is moved along a portion of the roughed-out shape 110 that is to be made, and finally the cutting-out tool 637 is moved out from the lens 100 substantially along another radius thereof, going away from the center of the lens 100, until the cutting-out tool disengages from the lens.

In a variant, provision can be made for the radial sector lines to be cut out before cutting out along the outline of the desired shape 110.

In a variant, to further reduce any risk of the lens slipping (when the lens is fragile or slippery) provision can also be made to cut out the lens 100 by performing a plurality of cutting out passes. Under such circumstances, prior to cutting out, both faces of the lens are felt firstly around the desired outline and secondly along the radial sector lines. Thereafter, roughing-out of the lens is performed by cutting out in a plurality of successive axial passes. The lens is cut out initially along the radial sector lines, each radial sector line requiring a plurality of passes, each involving a pass that is axially shallow. Thereafter, once the lens has been cut out along the radial sector lines, the lens is cut out along the desired lens outline. This cutting out requires a plurality of passes, each involving a pass that is axially shallow. The axial depths of the cutting-out passes are adjustable and the depths of the passes may typically be greater when cutting out along the radial sector lines than when cutting out along the desired final outline. Naturally, the axial pass depth of each pass is less than the maximum thickness of the lens along the desired outline. The depths and the number of passes may advantageously be defined as a function of geometrical data concerning the thickness of the lens as obtained by feeling both faces of the lens along the final outline.

During each cutting-out pass, the cutting-out tool 637 is controlled axially, i.e. in the transfer direction, as a function of the previously-obtained feeler data. Transfer control for cutting-out purposes along the radial sector lines is performed as a function of feeler data along those sector lines. Transfer control for cutting-out purpose along the desired final outline is carried out as a function of feeling along said desired outline.

The direction of rotation of the lens 100 (which constitutes the advance direction for machining) is reversed between two cutting-out passes. In the event of there being small amounts of rotary slip between the lens and its holder means, this avoids such slip accumulating in the same direction.

Provision can even be made for a fraction of a cutting-out pass to be performed while turning the lens relative to the cutting-out tool in a first direction of rotation and for the remaining fraction of the pass to be performed with rotation in a second direction opposite to the first direction of rotation.

Whatever the implementation used, instead of initially penetrating into the lens via the peripheral edge of the lens, provision can be made to position the cutting-out tool so as to drill the lens, by using its ability to move in the transfer direction relative to the lens, over some or all of the thickness of the lens, and then to move the cutting-out tool transversely along the desired line of cut while turning the lens.

Finishing the Shaping by Grinding

Thereafter, the shaping is finished by grinding using the finishing grindwheel 55. The beveling groove serves, where necessary, to provide a bevel in the edge face of the lens. The ability of the finishing grindwheel to move in transfer TRA and the ability of the lens to move in reproduction RES and in rotation ROT are controlled so as to achieve the desired final outline 120 while removing a small quantity of material situated between the roughed-out shape 110 obtained by cutting through the material and the desired final outline 120. Since the grains of the finishing grindwheel 55 are fine grains, the desired final outline 120 is obtained accurately.

The present invention is not limited in any way to the embodiments described and shown, and the person skilled in the art knows how to apply any variant thereto within the spirit of the invention.

In a variant, it is possible to make provision for using an appliance that does not include a tool for machining the edge face of the lens, and that does not include selector means, but that does include a tool for cutting through the material of the lens. That appliance is then used for cutting through the material of optical lenses coated in low surface energy treatments.

In a variant, the cutting-out tool can be steerable. For example, it can be steered by turning about an axis that is transverse to the axis of the cutter. This tool may also be used for drilling the lens. It can also be replaced by a drill bit that is used firstly for drilling the lens and secondly as a cutting-out tool for performing the function of cutting out the lens in the manner described above.

Other finishing stages, after finishing off the shaping using the finishing grindwheel, could be envisaged, such as grooving, drilling, and chamfering. In a variant, the grindwheel for roughing out the shape could be replaced by a device for cutting with a jet of water.

In a variant, provision could be made for the selector means to be automated in part only. Provision can thus be made for the selector means to include a program and an interface for communicating with an operator that are designed to propose a range of tools for roughing out the shape. The operator then selects the cutting-out tool or the machining tool for use in roughing out the shape manually via the communication interface.

The invention claimed is:

1. A method of shaping an optical lens (100), held by holder means (612, 613), the method comprising:

at least one operation of edging along a desired outline; and one operation of finishing an edge face of the lens, wherein the method includes an operation of selection that consists in making a selection between either a first tool (50) for machining the edge face of the lens (100), or a cutter tool (637) for cutting through the material of the lens (100), in order to perform the edging operation, as a function of one or more of the following parameters taken in isolation or in combination:

a parameter relating to the lens;

a parameter relating to the machining or cutting tools;

a parameter relating to the lens holder means (612, 613); and a parameter relating to the shape of the outline desired for the lens.

2. A shaping method according to claim 1, wherein said selection is performed as a function of the wetting angle of at least one of the faces of the lens.

3. A shaping method according to claim 2, wherein said selection is performed as a function of a parameter relating to the lens or of a combination of a parameter relating to the lens and a parameter relative to the lens holder means (612, 613), characterizing the maximum value of the torque that can be applied to the lens (100) without the lens slipping relative to the holder means (612, 613).

4. A shaping method according to claim 1, wherein said selection is performed as a function of a parameter relating to the lens or of a combination of a parameter relating to the lens and a parameter relative to the lens holder means (612, 613), characterizing the maximum value of the torque that can be applied to the lens (100) without the lens slipping relative to the holder means (612, 613).

5. A shaping method according to claim 1, wherein the parameter relating to the lens comprises the thickness of the lens.

6. A shaping method according to claim 1, wherein the parameter relating to the lens comprises a parameter relating to the material constituting the lens.

7. A shaping method according to claim 6, wherein the parameter relating to the lens comprises one of the following indicators:

the refractive index of the lens material;

the presence or the absence in the composition of the material constituting the lens of many substances that will be given off during machining.

8. A shaping method according to claim 1, wherein, in order to perform the edging operation, the tool (637) for cutting through the material of the lens (100) is selected if the shape desired for the outline of the lens presents at least one point of inflection, and otherwise the first tool (50) for machining the edge face of the lens (100) is selected.

9. A shaping method according to claim 1, wherein, in order to perform the edging operation, the tool (637) for cutting through the material of the lens (100) is selected if the shape of the outline desired for the lens presents at least one concave portion, and otherwise the first tool (50) for machining the edge face of the lens (100) is selected.

10. A shaping method according to claim 1, wherein the given shaping operation for which said selection is performed, is roughing out followed by finishing that is performed using a second tool (55) for machining the edge face of the lens (100) and that is distinct from the first tool (50) for machining the edge face of the lens (100).

11. A shaping method according to claim 1, wherein the diameter of the tool (637) for cutting through the material of the lens (100) is substantially less than the diameter of the first tool (50) for machining the edge face of the lens (100).

12. A shaping method according to claim 1, wherein cutting out the lens (110) comprises not only cutting out the lens along the desired outline, but also cutting out along radial sector lines lying between a plurality of peripheral sectors (101, 102, 103, 104).

13. A shaping method according to claim 12, wherein the radial lines are cut prior to cutting along the desired outline.

14. A shaping method according to claim 12, wherein, prior to cutting, at least one face of the lens is felt along the radial sector lines, and wherein, during cutting, the cutter tool (637) is controlled axially as a function of feeler data as picked up in this way.

15. A shaping method according to claim 1, wherein said selection consists in using the cutter tool when at least one face of the optical lens is coated in treatment that gives the surface of said face of the optical lens (100) a wetting angle that is greater than 100 degrees.

16. A device for shaping an optical lens (100) along a desired outline, the device comprising:

a first tool (50) for machining the edge face of the lens (100);

a cutter tool (637) for cutting through the material of the lens (100); and holder means (612, 613) for holding the lens during shaping;

selector means for selecting either the first tool (50) for machining the edge face of the lens (100), or the cutter tool (637) for cutting the lens (100), for at least one given edging operation, preceding a finishing operation, said selector means comprising determination means designed to determine whether the first tool (50) for machining the edge face of the lens (100) or the cutter (637) for cutting the lens (100) is to be selected, as a function of one or more of the following parameters, taken singly or in combination:

a parameter relating to the lens;

a parameter relating to the machining or cutting tools;

a parameter relating to the lens holder means (612, 613); and a parameter relating to the shape of the outline desired for the lens.

17. A device according to claim 16, characterized in that the cutter tool (637) for cutting the lens (100) is free to move relative to the lens along a direction parallel to the axis of the lens (100), and in that it includes a control unit adapted, during cutting, to control that freedom to move axially.

* * * * *